United States Patent [19]

Rabelos

[11] 4,056,166

[45] Nov. 1, 1977

[54] DETACHABLE FIRE ESCAPE DEVICE

[75] Inventor: Nicholas A. Rabelos, 7 Armour Lane, Riverdale, Ga. 30296

[73] Assignees: Thomas G. Clark; Kenneth B. Clary; J. Melvin England; Charles O'Brien, Jr.; Nicholas A. Rabelos, all of Atlanta, Ga.

[21] Appl. No.: 709,296

[22] Filed: July 28, 1976

[51] Int. Cl.[2] ..... A62B 1/14

[52] U.S. Cl. ..... 182/5; 188/65.2

[58] Field of Search ..... 182/5, 6, 7, 8, 10, 182/11, 193; 188/65.1, 65.2

[56] References Cited

U.S. PATENT DOCUMENTS

| | | | |
|---|---|---|---|
| 284,451 | 9/1883 | MacCarty | 188/65.1 |
| 527,529 | 10/1894 | Leber | 188/65.2 |
| 794,732 | 7/1905 | McKeeney | 188/65.1 |
| 1,357,962 | 11/1920 | Dalke | 188/65.2 |
| 2,205,933 | 6/1940 | Silvia | 188/65.1 |
| 2,343,086 | 2/1944 | Schultz | 188/65.2 |

*Primary Examiner*—Reinaldo P. Machado
*Attorney, Agent, or Firm*—Clarence A. O'Brien; Harvey B. Jacobson

[57] ABSTRACT

A fire escape in the form of an elongated flexible member anchored at its upper end to a building structure or stationary device associated with the building structure with the flexible member being of sufficient length to reach the ground or some other lower level by which a person may safely escape from a fire in the building. An attachable and detachable slide is mounted on the flexible member for longitudinal sliding movement in relation thereto with the rate of descent being manually controlled by a person supported therefrom by a belt type sling. The slide includes a pair of hingedly attached members having partial grooves in their facing surfaces for engaging the flexible member and a screw-threaded bolt and nut assembly connecting the hingedly connected members for moving the facing surfaces toward and away from each other for varying the frictional engagement between the slide and the flexible member. The attachable and detachable slide facilitates a plurality of individuals escaping from the same building enclosure on a single flexible member. The slide includes a hook thereon over which the lower portion of the flexible member may be entrained so that a person on the ground may control descent of the slide by tensioning the flexible member.

3 Claims, 3 Drawing Figures

Fig. 1
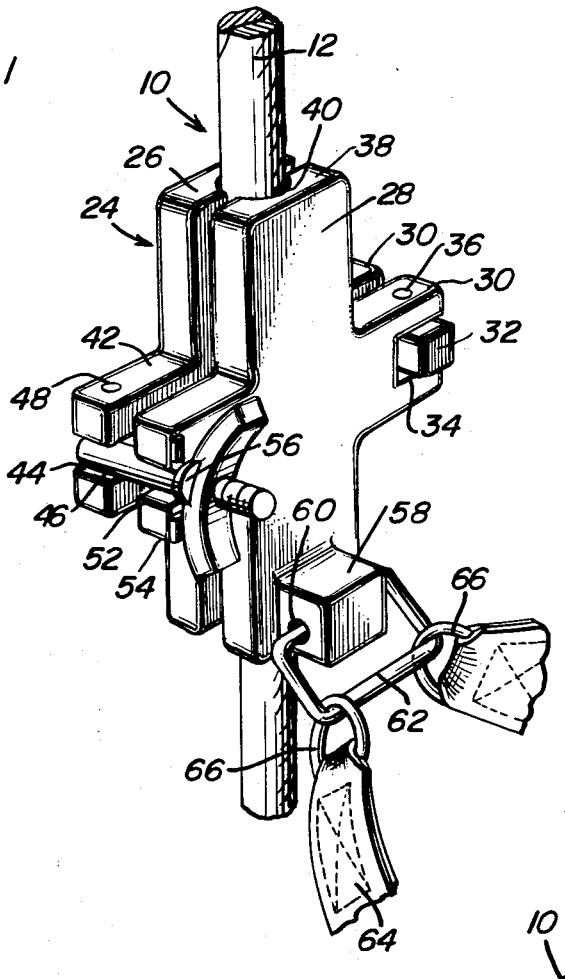
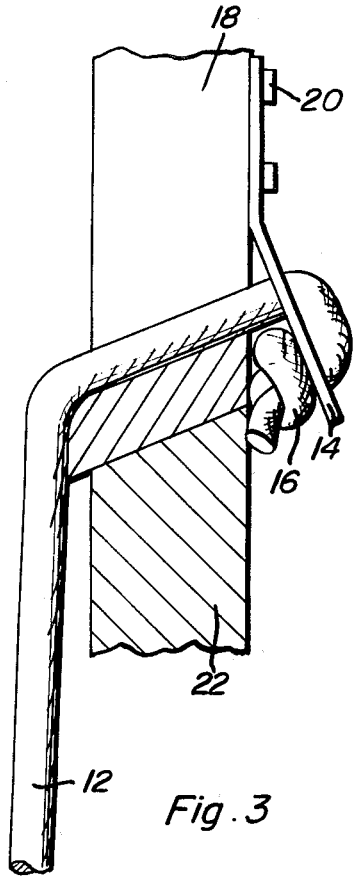
Fig. 3
Fig. 2
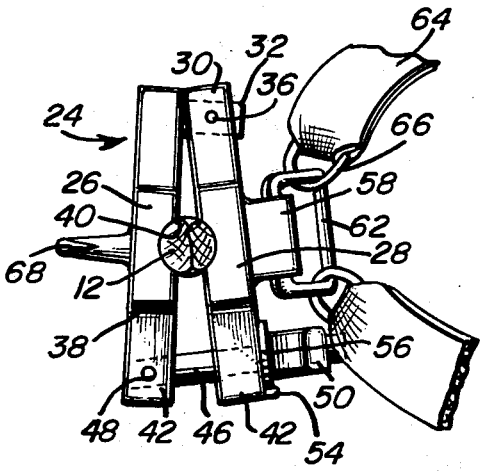
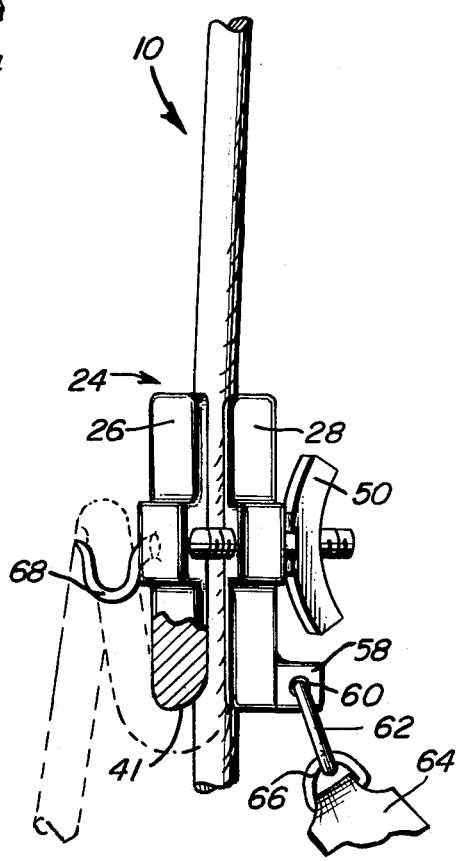

DETACHABLE FIRE ESCAPE DEVICE

BACKGROUND OF THE INVENTION

1. Field of the Invention

The present invention generally relates to a fire escape device and more particularly a device which enables persons trapped in the interior of a building or other enclosure to safely descend from the building with the device including an elongated flexible member and a slide detachably mounted on the flexible member with the slide including a sling for supporting a person and means for manually adjusting the rate of descent along the flexible member.

2. Description of the Prior Art

Many fatal injuries have resulted from persons being trapped in the interior of a building by a fire disposed between their location and a normal escape route provided in the building. This has been a particular problem in present-day high rise structures which usually are provided with only interior stairwells and elevator systems. Various devices have been provided for enabling such trapped individuals to escape by lowering themselves down the exterior wall of the building from a window opening or the like. My prior U.S. Pat. Nos. 3,507,763, issued Apr. 7, 1970, 3,765,507, issued Oct. 16, 1973 and 3,834,489, issued Sept. 10, 1974 and the other prior patents cited during prosecution of the applications which matured into these patents are representative of such devices. In many of the previous devices, the slide structure is assembled on the flexible member since the flexible member is threaded through the slide member thus necessitating that the person using the fire escape device put the sling on while positioned adjacent the flexible member. Thus, even though more than one slide member could be positioned on the flexible member, under near panic conditions which may exist, it sometimes occurred that a number of individuals adjacent the flexible member interfered with each other when trying to gain access to a sling since all of the slings would be located in an adjacent relation.

SUMMARY OF THE INVENTION

An object of the present invention is to provide a fire escape device including an elongated flexible member and a slide having a sling connected thereto for movement along the flexible member in which the slide is attachable to and detachable from the flexible member thus facilitating use of a single flexible member by a plurality of individuals each of which may have a slide and sling so that when such an individual approaches the flexible member, it would only be necessary that the slide connected with the sling which has already been placed in appropriate position under his arms need only be connected to the flexible member.

Another object of the invention is to provide a fire escape device in accordance with the preceding object in which the slide is in the form of a pair of hingedly connected plate members with hinge means at one longitudinal edge portion thereof and manually adjustable bolt and nut means at the other edge thereof for moving facing surfaces of the hingedly connected members into frictional engagement with the flexible member.

A further object of the invention is to provide a fire escape device in accordance with the preceding objects in which the slide is provided with an upwardly opening hook receiving a reversely folded portion of the lower end of the flexible member so that a person on the ground or at a lower level may control the descent of the slide on the flexible member by tensioning and loosening the suspended flexible member.

Still another object of the present invention is to provide a fire escape device having a detachable slide associated with an elongated flexible member which is relatively inexpensive to manufacture, extremely safe and dependable in operation and facilitates the escape of a plurality of individuals from a building or enclosure by using a single flexible member and a plurality of slide and sling assemblies.

These together with other objects and advantages which wll become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a perspective view of the fire escape device of the present invention illustrating the specific construction of the slide and the manner in which the sling is connected thereto.

FIG. 2 is a top plan view of the slide and associated components of the sling.

FIG. 3 is a side elevational view of the fire escape device illustrating a typical installation adjacent the window of a building structure.

DESCRIPTION OF THE PREFERRED EMBODIMENT

The fire escape device of the present invention is generally designated by reference numeral 10 and includes an elongated flexible member 12 in the form of a flexible rope of natural or synthetic fibre material formed in a conventional manner with the upper end thereof being inserted through a pair of aligned openings in a mounting bracket 14 and provided with a knot 16 to lock the rope 12 to the bracket 14 which may be supported along the inner surface of a window opening 18 by fastening bolts 20 or the like with the rope 12 extending exteriorly of the building structure 22 through the window opening 18. The bracket may be located adjacent the windowsill or at any position interiorly of the room enclosure or the rope may be connected to any other stationary object within the building enclosure. The rope may even be anchored to the leg of a large furniture item, bedstead or the like which will not exit through the window opening. The specific manner of connecting the rope to the building structure may be varied and adapted to the particular installational requirements with the rope 12 being sufficiently strong to support several individuals as they descend down the rope and the manner of connecting the rope to a stationary object is sufficient to support such weight. The length of the rope 12 is adequate to extend to the ground level or other safe lower levels from various floor levels in homes, apartment buildings, office buildings, hotels, motels, school buildings and any other similar buildings which are occupied by people above a ground floor. With the fire escape device 10 properly installed, one or more persons which may be trapped in the building enclosure may safely escape by descending along the rope 12.

The fire escape device 10 includes a slide 24 substantially of cruciform configuration and includes a pair of plates 26 and 28 of this configuration with the dimensions of the vertically and horizontally extending arms being varied as required. The plate 28 includes one of the horizontal arms 30 receiving a connector 32 in a bifurcated end 34. A pivot pin 36 extends through the connector 32 and the bifurcated end 34 of the arm 30 for hingedly connecting the plate 28 to the plate 26 in which the connector 32 is rigid with or integral with the horizontal arm 30 on the plate 26 as illustrated in FIG. 2. Alternatively, the connector 30 could be pivotally connected to both of the arms 30 to facilitate assembly and enable the components to be made out of standard stock components.

The facing surfaces of the vertical arms 38 of the plates 26 and 28 are each provided with a longitudinal groove 40 therein of partial cylindrical configuration for engaging a portion of the periphery of the rope 12 as illustrated in FIG. 2. The horizontally projecting arms 42 opposite from the arms 30 are also bifurcated as at 44 with a threaded bolt or rod 46 being connected to the arm 42 on plate 26 by a pivot pin 48 extending through the bifurcated end 44 and the threaded bolt or rod 46 so that the threaded bolt or rod 46 may be pivoted about the axis of the pin 48. A wing nut 50 is threaded on the bolt 46 with the bolt 46 being removably received in the bifurcated end 52 of the arm 42 on the plate 28. Thus, when the plates 26 and 28 are hinged towards each other with the rope 12 therebetween and the bolt 46 is then swung into the bifurcated end 52 of the arm 42 on the plate 28, the wing nut 50 may be tightened thus causing the slide 24 to frictionally grip the rope 12 to facilitate control of the rate of descent of the slide 24 on the rope 12. To prevent accidental disengagement of the wing nut 50 with the exterior surface of the arm 42 on the plate 28, projections 54 are provided on the surface of the arm 42 immediately outwardly of the wing nut 50 to preclude the wing nut 50 from sliding off of the surface of the arm 42. In order to enable the wing nut to be rotated, the inner surface thereof is provided with a substantially cylindrical boss 56 which will be received inwardly of the projections 54 and enable the extending wings of the wing nut 50 to pass over the projections 54 during rotation.

The exterior surface of the plate 28 is provided with a projecting block 58 on the lower end portion thereof as illustrated in FIG. 1 with a transverse bore 60 therein receiving a generally rectangular ring 62. The ring 62 receives the two ends of a sling 64 with each end of the sling including a D-ring 66 mounted on the rectangular ring 62 with the D-rings 66 being positioned on a portion of the ring 62 opposite from that portion of the ring 62 which extends through the mounting block 58. The sling 64 may be constructed of various types of webbing, belting or the like and is of a size to encircle a person's chest under the armpits in a manner similar to that shown in my prior patents. Thus, the sling 64 is permanently connected to the slide 24 and the slide 24 is attachable to and detachable from the rope 12. Thus, the building enclosure may be provided with a plurality of slides 24 and at least one rope 12 so that each individual in the enclosure may place the sling around his chest under his arms and hold the slide 24 so that it is in open condition. Such a person may then approach the rope 12 and attach his slide 24 thereto and descend along the rope 12 with the wing nut 50 being rotated in a manner to control his rate of descent. Such a person would normally securely tighten the wing nut 50 until he had exited the building and then loosen and tighten the wing nut 50 as required for controlling his rate of descent.

The plate 26 is provided with an upwardly opening hook 68 integral therewith which will receive the lower end portion of the rope 12 as illustrated in FIG. 3. This enables the lower end portion of the rope 12 to be moved rearwardly and positioned over the hook 68 when the slide 24 is positioned on the rope 12 thereby enabling the person descending the rope 12 to further control his rate of descent by tensioning the lower end portion of the rope below the slide 24 or enables a person on the ground to control the rate of descent by tensioning the rope 12. This enables an injured person or a person incapable of cntrolling his own rate of descent to be lowered by a person on the ground selectively tensioning the rope 12. For example, a school teacher in a building room could facilitate the connection of the slide to the rope for each child and position the rope 12 in the hook 68 and a person at ground level could control their rate of descent by tensioning the rope 12. Another example of this is the possibility that a nurse or other attendant personnel at a nursing home or the like could assist elderly patients or occupants in assembling the slide with the rope and a fireman at ground level could control their rate of descent. Even non-ambulatory patients could be lowered in slings of this type or stretchers or other devices attached to the sling 64 or attached to the slide 24 in any suitable manner. Thus, with this arrangement, a plurality of individuals may quickly and sefely exit from a building enclosure by sequentially and orderly connecting their slide and sling assembly to the rope 12 and quickly and safely desceding the rope with the rate of descent being controlled individually by the wing nut 50 or by tensioning the rope 12 when it is placed over the hook 68. To assure that the rope 12 will not be frictionally locked when engaged over the hook, the hook is provided with rounded surfaces and the bottom portion of the groove 40 in the plate 26 is curved rearwardly as indicated by numeral 41 in FIG. 3 so that the slide 24 will descend along the rope 12 when the wing nut 50 is loosened even though the rope 12 is positioned over the hook 68.

The attachable and detachable slide and sling may be readily connected to the rope which enables a building enclosure to be provided with a plurality of slide and sling assemblies commensurate with the number of occupants of the building enclosure. Only a single rope is necessary but, if desired, more than one rope may be provided depending upon the number of occupants involved so that all of the occupants can safely escape from the building by descending along the rope or ropes in a relatively short period of time. The slide may be assembled so that the wing nut 50 is either along the left edge or right edge of the slide and the shape and configuration of the wing nut may be varied, that is, it may be in the form of a knurled knob, handwheel or any other handle where rotational forces can be exerted on the threaded nut which is mounted on the threaded rod. The dimensional characteristics of the components of the slide may be varied depending upon the anticipated load requirements and the size of the grooves in the plates are such that the slide will be securely and positively locked to the rope by compression engagement and friction engagement with the rope substantially prior to the opposing surfaces of the plates 26 and 28 coming into contact with each other. Various structures may be provided for anchoring the rope in place depending upon the installational requirements for each individual installation. For example, the rope may be permanently attached to the building structure adjacent the window opening and the rope may be coiled into a small area and attractively covered by an enclosure or the like. However, the rope should be readily available and immediately accessible so that it can be dropped out of the window opening. Suitable printed instructions may be provided on each slide or adjacent the window opening for indicating the manner of using the slides and rope and in certain installations, it may be desirable to have training periods, fire escape drills and the like in order to acquaint the occupants with the structure and operation of the fire escape device.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention as claimed.

What is claimed as new is as follows:

1. A fire escape device comprising an elongated flexible member having an upper end capable of being anchored with respect to a building structure and having a length to depend to adjacent ground level or other safe level, a slide and sling assembly detachably mounted on the flexible member for longitudinal movement therealong, said slide and sling assembly including a slide in the form of a pair of hingedly connected plates provided with facing grooves receiving the flexible member, manually operated screw-threaded means interconnecting said plates for pivoting them towards and away from each other to selectively frictionally grip the flexible member for controlling the rate of descent of the slide along the flexible member, said slide and sling assembly including a projecting mounting block on the lower outer portion of the outer plate below said screw-threaded means, said slide and sling assembly including a sling connected to said block thereby enabling a person supported by the sling to manually manipulate the means for pivoting the plates in relation to each other, each of said plates being substantially cruciform in configuration, hinge means interconnecting the outer ends of one pair of horizontal arms, said means for pivoting said plates in relation to each other interconnecting the outer ends of the opposite pair of horizontal arms, said means for pivoting the plates in relation to each other including a threaded rod hingedly attached to a horizontal arm on one of said plates and a wing nut threaded onto said threaded rod and engaged with the arm on the other of said plates, said wing nut being disposed outwardly of the plate having the mounting block thereon whereby a person supported from the sling connected to the mounting block will have access to the wing nut.

2. The structure as defined in claim 1 wherein said plate opposite to the mounting block includes a projecting hook opening upwardly for receiving the lower end portion of the flexible member in a reversely folded condition so that tension exerted on the flexible member below the slide and sling assembly will control descent of the slide and sling assembly on the flexible member in conjunction with or independently of the wing nut.

3. The structure as defined in claim 2, wherein said hook is disposed above the lower edge of said plates whereby the flexible member will frictionally engage the lower edge of the inner plate when the flexible member is positioned in said hook and tension is applied to the flexible member below the plates, said horizontal arm engaged by the wing nut being slotted to enable pivotal movement of the threaded rod, the outer surface of the horizontal arm engaged by the wing nut including projecting means on the outer surface thereof adjacent the outer end of the slot for retaining the wing nut from accidental disengagement by movement of the wing nut from the free end of the outer surface of the arm.

* * * * *